US007829486B2

(12) United States Patent
Nobuto et al.

(10) Patent No.: US 7,829,486 B2
(45) Date of Patent: Nov. 9, 2010

(54) STRETCHABLE LEATHER-LIKE SHEET SUBSTRATE AND PROCESS FOR PRODUCING SAME

(75) Inventors: Yoshiki Nobuto, Okayama (JP); Yoshihiro Tanba, Okayama (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 368 days.

(21) Appl. No.: 10/765,834

(22) Filed: Jan. 29, 2004

(65) Prior Publication Data

US 2004/0242100 A1 Dec. 2, 2004

(30) Foreign Application Priority Data

Feb. 6, 2003 (JP) ..... 2003-029058
Aug. 29, 2003 (JP) ..... 2003-306938

(51) Int. Cl.
*D04H 1/00* (2006.01)

(52) U.S. Cl. ..... 442/363; 442/361; 442/340; 442/341; 428/904

(58) Field of Classification Search ..... 442/59, 442/327, 340, 351, 361, 363, 341; 428/904
See application file for complete search history.

(56) References Cited

U.S. PATENT DOCUMENTS

| | | | | |
|---|---|---|---|---|
| 4,476,186 | A * | 10/1984 | Kato et al. | 442/60 |
| 4,515,854 | A | 5/1985 | Kogame et al. | |
| 4,612,228 | A * | 9/1986 | Kato et al. | 428/151 |
| 5,393,600 | A * | 2/1995 | Omura et al. | 442/76 |
| 6,451,404 | B1 | 9/2002 | Nobuto et al. | |
| 6,737,372 | B2 * | 5/2004 | Minami et al. | 442/340 |
| 6,767,853 | B1 * | 7/2004 | Nakayama et al. | 442/361 |
| 6,784,127 | B1 * | 8/2004 | Yamakawa et al. | 442/409 |
| 2005/0009426 | A1 * | 1/2005 | Hwang et al. | 442/59 |

FOREIGN PATENT DOCUMENTS

| | | | |
|---|---|---|---|
| EP | 1 067 234 A2 | | 1/2001 |
| EP | 1 167 606 A1 | | 1/2002 |
| JP | 2-14056 | | 1/1990 |
| JP | 11-247023 | | 9/1999 |
| JP | EP 1067234 | * | 7/2000 |
| JP | 2000-248454 | | 9/2000 |
| JP | EP1067234 | * | 1/2001 |
| JP | EP 1067234 A | * | 1/2001 |
| JP | EP1213377 | * | 6/2001 |
| JP | 2001-214378 | | 8/2001 |
| JP | EP 1213377 A | * | 6/2002 |

OTHER PUBLICATIONS

U.S. Appl. No. 10/454,499, filed Jun. 5, 2003, Nobuto, et al.
Derwent Publications, AN 1985-096719, XP-002259130, JP 60-045656, Mar. 12, 1985.

* cited by examiner

*Primary Examiner*—Rena L Dye
*Assistant Examiner*—Jennifer Steele
(74) *Attorney, Agent, or Firm*—Oblon, Spivak, McClelland, Maier & Neustadt, L.L.P.

(57) ABSTRACT

The leather-like sheet substrate of the present invention comprises a fiber-entangled nonwoven fabric that comprises a microfine fiber bundle (A) and a microfine fiber bundle (B) in a blending ratio (A)/(B) of 30/70 to 70/30 by mass and a polymeric elastomer contained in the fiber-entangled nonwoven fabric. The microfine fiber bundle (A) comprises 10 to 100 microfine fibers each of which has a single fiber fineness of 0.5 dtex or less and which are made of an elastic polymer having a JIS A hardness of 90 to 97. The microfine fiber bundle (B) comprises a microfine fiber which has a single fiber fineness of 0.5 dtex or less and which is made of a non-elastic polymer. Because of its excellent stretchability in both the machine and transverse directions and drapeability, the leather-like sheet substrate is particularly suitable as the material for clothing.

6 Claims, No Drawings

STRETCHABLE LEATHER-LIKE SHEET SUBSTRATE AND PROCESS FOR PRODUCING SAME

BACKGROUND OF THE INVENTION

1. Field of the Invention

The present invention relates to a leather-like sheet substrate having an excellent stretchability, and more particularly to a leather-like sheet substrate having a stretchability causing substantially no structural deformation even after repeated elongation, a good softness, a good drapeability and a dense feel.

2. Description of the Prior Art

Hitherto, artificial leathers have been used in various applications such as clothes, interiors, shoes, bags and globes. In particular, in the wearing applications such as clothes, shoes and globes, the sense of wearing and fitting comfort is required. Therefore, artificial leather materials for use in these applications have been strongly required to have a good stretchability and drapeability. However, in conventional artificial leathers having a sponge-like structure composed of a nonwoven fabric made of microfine fiber and a wet-impregnated resin, the dense feel and stretchability which are characteristic of leathers are contradictory to the drapeability. For example, if the dense feel is enhanced, the drapeability tends to be deteriorated. Therefore, there is a strong demand for developing an artificial leather simultaneously satisfying all of appearance, stretchability, dense feel and drapeability.

More specifically, the artificial leather is basically composed of an microfine fiber-entangled nonwoven fabric made of a non-elastic polymer such as polyamides and polyesters and a polymeric elastomer, typically a polyurethane, which is impregnated in the nonwoven fabric. Therefore, the fiber-entangled nonwoven fabric is subjected to only a limited range of structural deformation by elongation. If deformed by elongation beyond the limited range, the fiber-entangled nonwoven fabric may fail to restore its original shape. Although the polyurethane contained in the nonwoven fabric is stretchable, a maximum deformation of the artificial leather structure by elongation depends on the maximum deformation of the fiber-entangled nonwoven fabric. If the amount of the polymeric elastomer is increased, the resultant artificial leather loses its drapeability because of the repulsion of the polyurethane.

In view of these circumstances, various studies have been made to attain an excellent stretchability by forming a nonwoven fabric from fibers of an elastic polymer such as polyurethane. For example, there has been proposed a synthetic leather using a nonwoven fabric made of melt-blown polyurethane filaments (e.g., Japanese Patent No. 3,255,615, page 2). The proposed synthetic leather exhibits a good stretchability. However, the polyurethane filaments are limited in reducing their fineness and are inherently easy to stick together because of the tackiness of polyurethane. Therefore, the proposed synthetic leather is unusable in the applications such as suede in which the quality of appearance is largely affected by the fineness of fibers. Various studies have been made to reduce the tackiness of polyurethane itself in the technical fields other than the artificial leather art. For example, there have been proposed a method of preventing the sticking between polyurethane fibers by a lubricant (e.g., Japanese Patent No. 3,230,703, pages 2-3; Japanese Patent No. 3,230,704, page 2; and Japanese Patent Application Laid-Open No. 48-19893, pages 6-9), a method of preventing the sticking between polyurethane fibers by colloidal silica (e.g., Japanese Patent Application Laid-Open No. 60-239519, page 2), and a method of directly reducing the tackiness by blending another component to polyurethane (e.g., Japanese Patent Publication No. 47-36811, pages 1-2). The prevention of the sticking by a lubricant is effective for polyurethane fibers having a large fineness. However, the preventing effect is insufficient for microfine fibers having a fineness of 0.5 dtex or less which is required for producing an artificial leather having both good appearance and feel, thereby causing the sticking and thickening of microfine fibers. The stuck and thickened fibers are no longer restored to microfine fibers by the buffing for raising fibers. In the method of physically providing interstices between fibers by colloidal silica, when simply applied to microfine fibers, the sticking between the microfine fibers may occur with colloidal silica holding therebetween. If the particle size of colloidal silica is increased, the falling-off of colloidal silica held between microfine fibers becomes significant to result in the sticking of microfine fibers, thereby lessening the effect. The method of blending another component to polyurethane cannot simultaneously satisfy all the appearance, stretchability, dense feel and drapeability because the inherent stretchability of polyurethane is inhibited.

SUMMARY OF THE INVENTION

An object of the present invention is to provide a leather-like sheet substrate having a good stretchability in both the machine and transverse directions thereof, a good drapeability and a soft touch and feel. Another object of the present invention is to provide a process for producing the leather-like sheet substrate.

To solve the above problems, the inventors have made extensive study on the properties of elastic polymers, the blending ratio between the microfine fibers made of elastic polymer (elastic microfine fibers) and the microfine fibers made of non-elastic polymer (non-elastic microfine fibers), the structure of leather-like sheet, etc. As a result thereof, the inventors have found that the tackiness of elastic microfine fibers can be suitably controlled to thereby enable the production of a leather-like sheet substrate having a good hand and feel, by limiting the hardness of elastic polymer, the number of single elastic polymer fibers constituting a microfine fiber bundle and the blending ratio of the microfine fiber bundle of the elastic microfine fibers and the microfine fiber bundle of the non-elastic microfine fibers. The inventors have further found that the leather-like sheet substrate, if made into a suede-finished leather-like sheet in particular, can provide a leather-like sheet having an improved appearance and satisfying both the stretchability and mechanical strength. The present invention has been accomplished on the basis of these findings.

Thus, the present invention provides a leather-like sheet substrate comprising a fiber-entangled nonwoven fabric that comprises a microfine fiber bundle (A) and a microfine fiber bundle (B) in a blending ratio (A)/(B) of 30/70 to 70/30 by mass and a polymeric elastomer contained in the fiber-entangled nonwoven fabric, the microfine fiber bundle (A) comprising 10 to 100 microfine fibers each of which has a single fiber fineness of 0.5 dtex or less and which are made of an elastic polymer having a JIS A hardness of 90 to 97, and the microfine fiber bundle (B) comprising a microfine fiber which has a single fiber fineness of 0.5 dtex or less and which is made of a non-elastic polymer. It is preferred for the microfine fibers in the microfine fiber bundle present inside the leather-like sheet substrate to partially stick to each other. Alternatively, the leather-like sheet substrate preferably contains a powder having an average particle size of 0.1 to 5 μm at least between the microfine fibers of the microfine fiber bundle (A).

The present invention further provides a suede-finished leather-like sheet comprising the leather-like sheet substrate, in particular, a suede-finished leather-like sheet in which raised single fibers formed by the microfine fibers of the microfine fiber bundle (A) are not substantially stuck to each other.

The present invention still further provides a grained leather-like sheet comprising the leather-like sheet substrate.

The present invention still further provides a process for producing a leather-like sheet substrate, comprising at least the following steps (1) to (6):

(1) a step of producing a microfine fiber-forming fiber (A') capable of forming a microfine fiber bundle (A) comprising 10 to 100 microfine fibers each of which has a single fiber fineness of 0.5 dtex or less and which are made of an elastic polymer having a JIS A hardness of 90 to 97;

(2) a step of producing a microfine fiber-forming fiber (B') capable of forming a microfine fiber bundle (B) comprising microfine fibers each of which has a single fiber fineness of 0.5 dtex or less and which are made of a non-elastic polymer;

(3) a step of producing a fiber-entangled nonwoven fabric (A) by blending the microfine fiber-forming fiber (A') and the microfine fiber-forming fiber (B') so that a blending ratio of the microfine fiber bundle (A) to the microfine fiber bundle (B) is 30/70 to 70/30 by mass when the microfine fiber-forming fibers (A') and (B') are made into the microfine fibers, thereby producing a web, and by three-dimensionally entangling the web;

(4) a step of producing a fiber-entangled nonwoven fabric (B) by heat-shrinking the fiber-entangled nonwoven fabric (A) at 85° C. or higher;

(5) a step of impregnating a polymeric elastomer into the fiber-entangled nonwoven fabric (B); and (6) a step of making the microfine fiber-forming fiber (A') and the microfine fiber-forming fiber (B') into the microfine fibers to form the microfine fiber bundle (A) and the microfine fiber bundle (B).

With its good stretchability in both the machine direction and the transverse direction, good drapeability and soft touch and feel, the leather-like sheet substrate of the present invention can be made into a suede-finished leather-like sheet simultaneously exhibiting a good writing property and a high-class appearance, and a grained leather-like sheet having a natural touch or feel like natural leathers. The leather-like sheet substrate exhibiting a good stretchability in both the machine direction and the transverse direction is suitable particularly for clothing applications.

DETAILED DESCRIPTION OF THE INVENTION

The present invention will be described in detail below.

The microfine fiber made of an elastic polymer (elastic microfine fiber) and the microfine fiber made of a non-elastic polymer (non-elastic microfine fiber) used in the present invention are each produced by removing an island component by dissolution or decomposition from a microfine fiber-forming fiber which is made of at least two different polymers which are less compatible to each other and which has a cross section comprising the island component of at least one polymer and a sea component of at least one different polymer. In the present invention, as the island component, an elastic polymer is used in the microfine fiber-forming fiber (A') for forming the microfine fiber bundle (A), and a non-elastic polymer in the microfine fiber-forming fiber (B') for forming the microfine fiber bundle (B).

The elastic polymer for forming the elastic microfine fiber is a polymer exhibiting an extension elastic recovery of 50 to 100% as measured one minute after 50% extension of its fiber at 25° C. The extension elastic recovery is preferably 80 to 100% in view of good stretchability and shape retention of the resultant leather-like sheet substrate. The non-elastic polymer for forming the non-elastic microfine fiber is a polymer exhibiting an extension elastic recovery of less than 50% as measured under the same conditions as described above. In general, the low extension elastic recovery of the non-elastic polymer having an extension elastic recovery of less than 50% is attributable to its high crystallizability and high cohesive force. Therefore, the combined use of the non-elastic polymer is preferred to enhance the mechanical properties, particularly the breaking strength and peeling strength of the leather-like sheet substrate. The limit of extension percentage of the non-elastic polymer is preferably less than 50% as measured at 25° C.

Examples of the elastic polymer include polyurethanes, polyisoprenes, conjugated diene polymers such as polybutadiene, polymers having conjugated diene polymer blocks in its molecule, and other spinnable polymers showing a rubber elastic behavior represented by the above extension elastic recovery, with the polyurethanes being preferred in view of good heat resistance. If the heat resistance is low, the resultant microfine fibers tend to stick together into an integral body upon heat treatment or by frictional heat generated during the buffing for suede finishing. The thermoplastic polyurethane usable in the present invention is preferably a polyurethane produced by the reaction of at least one polymer diol (soft segment) having an average molecular weight of 600 to 3,500 which is selected, for example, from the group consisting of polyester glycols obtained by the polycondensation of glycol and aliphatic dicarboxylic acid, polylactone glycols obtained by the ring-opening polymerization of lactone, aliphatic or aromatic polycarbonate glycols and polyether glycols with an organic diisocyanate such as tolylene diisocyanate, 4,4'-diphenylmethane diisocyanate, isophorone diisocyanate and 4,4'-dicyclohexylmethane diisocyanate in the presence of a low-molecular chain extender having at least two active hydrogen atoms.

The elastic polymer is preferably a so-called thermoplastic polymer having a JIS (Japanese Industrial Standard) A hardness of 90 to 97, preferably 93 to 97 in view of preventing the sticking and improving the fiber strength. If less than 90, the tackiness of the elastic polymer itself is increased. Therefore, particularly in the production of suede-finished leather-like sheet, the elastic microfine fibers exposed to the surface tend to stick to each other in each fiber bundle or between different bundles, lowering the quality of touch, appearance of raised fibers, etc. In addition, the repulsion tends to become high when the degree of sticking of the elastic microfine fibers inside the leather-like sheet substrate increases, this likely to deteriorate the drapeability and feel. In particular, when a component that is removable by dissolution in solvent is used as the sea component, the elastic polymer as the island component tends to be swelled with the solvent and partially dissolved therein, thereby unfavorably promoting the sticking of the elastic microfine fibers into integral body. On the other hand, if the JIS A hardness exceeds 97, the elastic microfine fibers inside the resultant leather-like sheet substrate become difficult to partially stick together, this lowering the binder effect to likely to deteriorate the mechanical strength such as breaking strength of the leather-like sheet substrate or lower the extension elastic recovery of the leather-like sheet substrate itself.

The JIS A hardness of polyurethane tends to increase with increasing amount of the isocyanate compound for constituting the hard segment, although slightly influenced by the kind of diol component. The JIS A hardness may be regulated within 90 to 97 by controlling the content of the isocyanate compound by known methods.

The average single fiber fineness of the elastic microfine fiber is 0.5 dtex or less in view of obtaining a good feel and touch and a good appearance. In addition, 10 to 100 elastic microfine single fibers are bundled to form each microfine fiber bundle (A). If the average single fiber fineness exceeds 0.5 dtex, the resultant leather-like sheet substrate tends to be deteriorated in touch or feel. Particularly, when made into a suede-finished leather-like sheet, the raised surface tends to be rough and the writing effect tends to be poor. Although not critical, the lower limit of the average single fiber fineness is preferably 0.005 dtex or more because the surface area of fibers increases as the fineness decreases and the sticking tendency of the elastic microfine fibers in the microfine fiber bundle may be strengthened. The average single fiber fineness is more preferably 0.01 to 0.1 dtex.

If the number of the single fibers (elastic microfine fibers) constituting the microfine fiber bundle (A) is less than 10, the suede-finished leather-like sheet tends to have a rough appearance. In addition, the single fibers inside the leather-like sheet substrate tend to become difficult to partially stick together owing to a reduced total surface area thereof to reduce the binding effect, thereby lowering the mechanical strength and extension elastic recovery of the resultant leather-like sheet substrate. Further, since the fineness of the microfine fiber-forming fiber (A') inevitably becomes small, the fiber break is caused during the production thereof and the carding properties are adversely affected. Additionally, when the number of single fibers is too small, the single fibers are difficult to partially stick together even if the JIS A hardness of the elastic polymer is 90 to 97. When an elastic polymer having a JIS A hardness of less than 90 is used to ensure the partial sticking between the single fibers, the mechanical strength of the resultant leather-like sheet substrate tends to be deteriorated. On the other hand, when the number of the single fibers exceeds 100, the total surface area of the single fibers becomes large to make the single fibers more easy to stick together than needed, resulting in a poor leather-like feel and drapeability. In particular, the resultant suede-finished leather-like sheet is poor in its suede touch and appearance. When the number of single fibers is too large, the single fibers are easy to stick together even if the JIS A hardness of the elastic polymer is 90 to 97. When an elastic polymer having a JIS A hardness exceeding 97 is used to prevent the sticking, the spinning stability may be lowered and the feel and hand of the leather-like sheet substrate may become hard.

The microfine fiber-forming fiber (A') may be produced by a known sea/island composite spinning method. The composite spinning method, unlike a mix spinning method, makes the shape of island and the fineness of fibers constant thereby to make it easy to reduce the area and number of the contact points between the elastic microfine fibers. Thus, the composite spinning method is preferred because the sticking of the elastic microfine fibers can be limited to a required minimum.

To attain a satisfactory partial sticking and excellent drapeability, touch or feel, mechanical properties, and appearance of raised fibers when made into a suede-finished leather-like sheet, it is preferred for the microfine fiber bundle (A) to satisfy the formula: $D1/D2 \leqq 2$ wherein D1 is a maximum single fiber diameter and D2 is a minimum single fiber diameter of 10 to 100 single fiber diameters which are observed in a cross-sectional image of the microfine fiber bundle (A) on a 2,000× cross-sectional electron microphotograph of the leather-like sheet substrate.

Examples of the non-elastic polymer include nylons such as nylon-6, nylon-6,6, nylon-6,10 and nylon-12; other spinnable polyamides; spinnable polyesters such as poly(ethylene terephthalate), poly(butylene terephthalate), poly(butylene terephthalate) copolymers, aliphatic polyesters and aliphatic polyester copolymers; acrylonitrile copolymers; and saponified ethylene-vinyl acetate copolymers.

In the present invention, the average single fiber fineness of the non-elastic microfine fiber is 0.5 dtex or less. If exceeding 0.5 dtex, the resultant leather-like sheet substrate tends to be deteriorated in touch or feel. In particular, when made into a suede-finished leather-like sheet, the raised surface tends to be rough and the writing effect tends to be poor. Although not particularly restricted, the lower limit of the average single fiber fineness is preferably 0.0001 dtex or more, because the breaking strength and tear strength of the resultant leather-like sheet substrate tend to be deteriorated and the color development after dyeing tends to be poor when the fineness is excessively small. The average single fiber fineness is more preferably 0.001 to 0.1 dtex.

The microfine fiber-forming fiber (B') may be suitably produced by known methods such as a sea/island composite spinning method and a sea/island mix spinning method. Both the sea components of the microfine fiber-forming fibers (A') and (B') may be selected from the same viewpoints. The sea component is selected from polymers soluble to a solvent which does not dissolve the island components. Examples of such polymers include polyolefins such as polyethylene, polypropylene and polybutylene, olefin copolymers, polystyrene and styrene copolymers. From the viewpoint of environmental protection, thermoplastic polyvinyl alcohol, etc., which are extractable with hot water may be also used. The sea component of the microfine fiber-forming fiber (A') and the sea component of the microfine fiber-forming fiber (B') may be the same or different. Preferred is a combination of the sea components both soluble in the same solvent, because both sea components are removed after mixing the microfine fiber-forming fibers (A') and (B'). The solvent is preferably non-solvent to both the single fibers constituting the microfine fiber bundles (A) and (B). The words "dissolution of fiber" and its similar wording used herein mean the lost of fibrous shape due to substantial dissolution of fiber in a solvent, but exclude the dissolution or swelling of a very small part of fiber component if the fibrous shape is substantially retained.

It is preferred to add a powder having an average particle size of 0.1 to 5 μm to the sea component, particularly to the sea component of the microfine fiber-forming fiber (A'). A part of the added powder remains between the elastic microfine fibers made of the island component even after removing the sea component from the microfine fiber-forming fibers (A') by extraction thereby to physically form interstices between the elastic microfine fibers. The interstices thus formed prevent the elastic microfine fibers inside the leather-like sheet substrate from sticking together excessively. Particularly, in case of the suede-finished leather-like sheet, the microfine fiber bundle (A) becomes easy to be fibrillated into individual microfine fibers in the raising operation, resulting in an improved appearance due to a high density of raised fiber density and a high writing effect.

Examples of the powder include, but are not particularly limited to, silicone powder, barium sulfate, talc, magnesium oxide, titanium oxide and glass powder. The average particle size of the powder is preferably 0.1 to 5 μm and more preferably 0.5 to 2 μm. When the average particle size is within the above range, the effect of preventing the sticking between the elastic microfine fibers is enhanced, and the reduction of the effect of preventing the sticking due to the falling-off of the powder between the elastic microfine fibers and the deterioration of spinnability can be avoided.

The powder may be added at the spinning stage. Since the powder exhibits its effect when present between the elastic microfine fibers, the powder is blended in the polymer constituting the sea component by a master batch method or a dry-blending method, preferably by a master batch method. In the master batch method used herein, polymer chips prepared in advance by blending the powder in a high concentration is blended with polymer chips for the sea component which contain no powder at the spinning stage. The base polymer of the master batch is preferably the same as the polymer for the sea component. In some cases, different polymers are used unless the spinnability and fiber properties are adversely affected. In the dry-blending method used herein, a given amount of the powder is directly added to polymer chips for the sea component at the spinning stage.

The microfine fiber bundles (A) and (B) may be optionally colored by incorporating a colorant such as carbon black and other pigments into each polymer component in order to attain a deep-colored appearance in the case of suede-finished leather-like sheet and in order to attain a natural appearance by adjusting the colors of the surface and the sheet substrate to similar color tones like natural leathers in the case of grained leather-like sheet. The addition amount of the colorant such as carbon black is preferably 8 parts by mass or less based on 100 parts by mass of each polymer component in view of spinnability and strength/extension properties of resultant fibers.

After blending, the microfine fiber-forming fibers (A') and (B') are made into microfine fibers to form the microfine fiber bundles (A) and (B), respectively. The blending ratio, (A')/(B'), should be selected so that a blending ratio, microfine fiber bundle (A)/microfine fiber bundle (B), is 30/70 to 70/30 by mass when the microfine fiber-forming fibers (A') and (B') are made into the microfine fibers. The blending ratio, (A)/(B), is preferably 40/60 to 60/40 in view of appearance, stretchability, drapeability and softness. When the content of the microfine fiber bundle (A) is less than 30, the extension elastic recovery of the resultant leather-like sheet substrate is lowered to result in the deterioration of the stretchability, drapeability and softness. When the content exceeds 70, the mechanical properties such as strength is likely to be reduced.

The method of blending the microfine fiber bundles (A) and (B) may include a method in which the microfine fiber-forming fibers (A') and (B') in a predetermined ratio are gathered into a bunch which is then drawn, crimped and cut to obtain a mixed raw stock, and a method in which microfine fiber-forming fibers (A') and (B') are separately drawn, crimped and cut to produced respective raw stocks which are then blended in a blender. Also known is a blending method by a composite mix spinning in which the island components for the elastic microfine fiber and the non-elastic microfine fiber are simultaneously present in a single microfine fiber-forming fiber. In this method, the elastic microfine fiber constituting the microfine fiber bundle (A) is present inevitably close to the non-elastic microfine fiber constituting the microfine fiber bundle (B). Therefore, the elastic microfine fiber and the non-elastic microfine fiber may stick together in the removal of the sea component to impair the stretchability of the elastic microfine fiber.

As described above, to enhance the stretchability, the touch or feel such as drapeability and the mechanical properties such as strength of the leather-like sheet substrate intended in the present invention, the elastic microfine fibers in the microfine fiber bundle (A) constituting the inside of the leather-like sheet substrate preferably has a partially sticking structure. The partially sticking structure used herein means that the elastic microfine fibers in the microfine fiber bundle (A) laterally stick together while keeping their original fibrous shape, and that the sticking length is ⅔ or less of the fiber diameter when measured on a cross section perpendicular to the lengthwise direction of fibers. To attain a good appearance of raised fibers of the suede-finished leather-like sheet, the raised fibers formed from the elastic microfine fibers are preferably substantially free from sticking. To ensure this, it is important to control the degree of sticking within a range which is neither too high nor too low but moderate, by limiting the hardness of the elastic polymer, the fineness of the elastic microfine fiber and the number of the single fibers which constitute the microfine fiber bundle (A) within the ranges mentioned above. It is also preferred to allow the powder to present between the single fibers.

The polymeric elastomer to be impregnated into the fiber-entangled nonwoven fabric composed of the microfine fiber-forming fibers (A') and (B') may be selected from known resins conventionally used for the production of leather-like sheets. Examples thereof include polyurethane-based resins, polyvinyl acetate-based resins, polyvinyl butyral-based resins, polyacrylic acid-based resins, polyamino acid-based resins, silicone-based resins and mixtures of these resins. These resins may be copolymers. Most preferably used is a polymeric elastomer mainly comprising a polyurethane resin, because the touch or feel and properties of the resultant leather-like sheet substrate are well balanced. The polymeric elastomer is impregnated into the fiber-entangled nonwoven fabric in the form of an aqueous emulsion or a solution in organic solvent, and then solidified. In view of recent increasing concern for environmental protection, an aqueous emulsion of the polymeric elastomer is more preferably used.

As described above, the polymeric elastomers which can be made into aqueous emulsions are preferably used in the present invention. Generally, emulsions containing dispersed particles made of only polyurethane are used. In view of costs and properties, a core/shell type emulsion containing dispersed particles having a outermost shell made of polyurethane and an inner core made of a relatively cheap resin such as (meth)acrylic resin may be effectively used. The polyurethane aqueous emulsion may be produced by known methods, for example, by a so-called forced emulsification method in which a polyurethane solution in a solvent and water are forced to be mechanically stirred in the presence of an emulsifier, and then the solvent is removed, or a self-emulsification method in which a polyurethane having hydrophilic groups as a part of its copolymerized component is emulsified in water without emulsifier.

As the polyurethane to be impregnated, there may be used any of conventionally known polyurethanes, for example, those produced by the reaction of a predetermined molar ratio of at least one polymer diol having an average molecular weight of 500 to 3,000 selected from polyester diols, polyether diols, polycarbonate diols, etc.; at least one diisocyanate selected from aromatic, alicyclic and aliphatic diisocyanates such as 4,4'-diphenylmethane diisocyanate, isophorone diisocyanate and hexamethylene diisocyanate; and at least one compound with a molecular weight of 300 or less having two or more active hydrogen atoms selected from, for example, diols such as ethylene glycol, propylene glycol, butane diol and 3-methyl-1,5-pentane diol, diamines such as ethylenediamine, isophoronediamine, piperazine and phenylenediamine, and hydrazides such as adipohydrazide and isophthalylhydrazide. The polyurethane may also be used in the form of a polymer composition containing other polymers such as synthetic rubbers and polyester elastomers.

Since no organic solvent is used, the aqueous emulsion of the polymeric elastomer is less harmful to environment. In addition, unlike the wet solidification in a solution in solvent, the polymeric elastomer in the aqueous emulsion is prevented from forming a sponge-like structure to minimize the repulsion of the resultant leather-like sheet substrate and make it easy to develop the drapeability.

The ratio of the polymeric elastomer and the microfine fibers (elastic microfine fiber+non-elastic microfine fiber) in the leather-like sheet substrate is preferably 5/95 to 50/50, more preferably 7/93 to 35/65 by mass when using the aqueous emulsion of the polymeric elastomer, and preferably 3/97 to 30/70, more preferably 5/95 to 20/80 by mass when using the solution of the polymeric elastomer in solvent. The ratio in the above range is preferred in view of achieving a soft feel and hand and good drapeability, stretchability and breaking strength.

Next, the production method of the present invention will be explained.

The microfine fiber-forming fiber (A') is produced by spinning an elastic polymer (island component) having a JIS A hardness of 90 to 97 and a polymer (sea component) selected from a group of polymers mentioned above from a composite spinning nozzle so as to have the number of islands of 10 to 100. In view of stable island shape and stable spinning operation, it is preferred to use a nozzle that is designed so as to inject the island component through a needle pipe disposed in the sea component. In particular, when a hot water-extractable thermoplastic polyvinyl alcohol, for example, as described in Japanese Patent Application Laid-Open Nos. 2000-234214 and 2000-234215, is used as the sea component, it is preferred to shorten the residence time of polymer in the nozzle taking the stability of heat resistance into consideration. To ensure this, suitably used is a nozzle, as described in Japanese Patent Application Laid-Open Nos. 7-3529 and 7-26420, having an etching plate-type nozzle element comprising a thin plate and a polymer path etch-formed thereon. The ratio, island component/sea component, is not critical in the present invention, and preferably 90/10 to 30/70, more preferably 80/20 to 50/50 by mass.

The microfine fiber-forming fiber (B') may be produced by a known spinning method. The non-elastic polymer is used as the island component. As the sea component, the same polymer as used for the sea component of the microfine fiber-forming fiber (A') is preferably used. The microfine fiber-forming fiber (B') may be either a composite spun fiber or a mix spun fiber. Although not particularly limited as long as the average single fiber fineness is 0.5 dtex or less, the number of islands is preferably 10 to 10,000 and the ratio, island component/sea component, is preferably 90/10 to 30/70, more preferably 80/20 to 50/50.

The mass coloration of fibers by a colorant such as carbon black, if employed, may be carried out by dry-blending the colorant with pellets of resin for the spinning raw material. Alternatively, the colorant may be blended as a color master batch containing, as the base resin, a raw resin and optionally another resin in an amount not adversely affecting the spinnability.

After spinning, each microfine fiber-forming fiber is made into fiber staples (preferably 10 to 100 mm long) through the steps of drawing, crimping, cutting, etc. The drawing may be conducted by a known method. In particular, the microfine fiber-forming fiber (A') containing the elastic polymer is preferably drawn at a draw ratio 0.6 to 0.9 time its elongation at break which is measured in the heat-treating atmosphere (preferably 20 to 200° C.) for the drawing. With such a drawing, the resultant elastic microfine fiber acquires a hot water shrinkage of 15% or more at 90° C. and shrinks in the subsequent heat-shrink treatment to make the resultant leather-like sheet substrate stretchable. By drawing the microfine fiber-forming fiber (B') in the same manner, the resultant leather-like sheet substrate acquires sufficient mechanical properties.

Then, the microfine fiber-forming fibers (A') and (B') are blended with each other by the method described above. The fineness of fiber staples is preferably 1.0 to 10.0 dtex, more preferably 3.0 to 6.0 dtex to ensure a good card-passing property. The fineness of the microfine fiber-forming fiber (A') may be the same as or different from that of the microfine fiber-forming fiber (B'), and preferably the same in view of a good card-passing property.

Next, the fiber staples are carded and passed through a webber to form webs which are then stacked to have desired weight and thickness. The stacked webs are then made into a three-dimensionally entangled nonwoven fabric (A) by a known method, for example, by a needle punching and a high-pressure hydroentanglement. Alternatively, the three-dimensionally entangled nonwoven fabric (A) is obtained by entangling a knitted or woven fabric stacked with fiber staples using water jet, etc.

The fiber-entangled nonwoven fabric (A) is preferably formed into a desired configuration while taking the thickness, etc. of the final artificial leather into consideration. Preferably, the basis weight is 200 to 1,500 g/m$^2$ and the thickness is 1 to 10 mm because of easiness of handling in the production steps.

It is important to shrink the fiber-entangled nonwoven fabric thus prepared at 85 to 130° C. under any of hot-water heating, dry heating and moist heating. When the sea component of the microfine fiber-forming fibers (A') and/or (B') is a thermoplastic polyvinyl alcohol, the shrinking under dry heating is preferred because the sea component is soluble in hot water. Upon heating, the microfine fiber-forming fibers (A') and (B') constituting the fiber-entangled nonwoven fabric (A) shrink to thereby impart a sufficient stretchability to the resultant leather-like sheet substrate. In addition, the density of the nonwoven structure increased to make the leather-like sheet substrate dense, thereby creating a natural leather-like touch or feel and improving the appearance of the suede-finished leather-like sheet. The heat-shrink at temperatures lower than 85° C. is not preferred, because the shrinkage may be insufficient, the resultant leather-like sheet substrate may have poor stretchability and extension elastic recovery, and particularly, the appearance of the suede-finished leather-like sheet may be deteriorated.

The surface of the heat-shrunk fiber-entangled nonwoven fabric (B) is, if desired, smoothed by heat press, etc. The surface-smoothing treatment improves the surface smoothness of the grained leather-like sheet and enhances the appearance of the suede-finished leather-like sheet.

The fiber-entangled nonwoven fabric (B) is impregnated with the polymeric elastomer by known methods such as a method of immersing the fiber-entangled nonwoven fabric (B) in an aqueous emulsion of the polymeric elastomer, a solution thereof in an organic solvent, etc. and then squeezing the fabric, and a method of penetrating the polymeric elastomer into the fiber-entangled nonwoven fabric (B) by using a coater such as a lip coater.

After impregnated with the solution of the polymeric elastomer, the fiber-entangled nonwoven fabric (B) is immersed in a water-based coagulation bath to solidify the polymeric elastomer into a porous structure. Alternatively, the polymeric elastomer in the aqueous emulsion is solidified by a hot-air dryer. Since the migration tends to occur during the drying, it is preferred to blend a known acrylic- or silicone-based heat-sensitive gelling agent to the emulsion or to employ a solidification method by wet heating or infrared irradiation to prevent the migration.

The solution or emulsion of the polymeric elastomer may be optionally added with an additive such as softening agents, flame retardants, colorants such as dyes and pigments, etc., according to requirements, unless the addition thereof adversely affects the objects and effects of the present invention.

As described above, the microfine fiber-forming fibers (A') and (B') are converted into microfine fiber bindles (A) and (B) each respectively comprising the elastic microfine fiber and the non-elastic microfine fiber, by treating them with a liquid substance which is a non-solvent for the island polymers and the polymeric elastomer if already impregnated therein, but dissolves or decomposes the sea polymers. As such a liquid substance, water, hot water, etc. are usable when the sea component is a thermoplastic polyvinyl alcohol, and toluene, xylene, trichlene, etc. are usable when the sea component is polyolefin, olefin copolymer, polystyrene or styrene copolymer. The conversion into microfine fibers is preferably conducted by immersing the fiber-entangled nonwoven fabric (B) in the liquid substance for 5 to 30 min at 60 to 130° C. to remove the sea component by extraction and/or decomposition. The drying after the conversion into microfine fibers is preferably conducted in an atmosphere of 80 to 130° C. to remove the liquid substance remaining in the leather-like sheet substrate and allow an appropriate sticking between the elastic microfine fibers and between the elastic microfine fiber and the adjacent non-elastic microfine fiber.

The step for impregnating the polymeric elastomer and the step for forming the microfine fibers may be performed in either this order or reverse order.

The leather-like sheet substrate of the present invention may be made into the suede-finished leather-like sheet by buffing with sandpaper to nap its surface, thereby forming raised microfine fibers. By the high-speed buffing with sandpaper, the microfine fiber bundle (A) is fibrillated into raised microfine fibers comprising independent, individual elastic microfine fibers. The surface of the leather-like sheet substrate may be dissolved by a solvent or melted by heat before or after forming the raised microfine fibers. By such a treatment, a leather-like sheet having a nubuck-like appearance with a short nap or a medium appearance between the suede finish and the grain finish.

The leather-like sheet substrate of the present invention may be made into the grained leather-like sheet by forming a resin film on its surface. The surface resin film may be formed by, in addition to known wet methods and dry methods, a known grained layer-forming method such as a method in which the surface of the leather-like sheet substrate dissolved by a solution is smoothed or impressed with relief design by embossing; and a method in which a nonwoven fabric of polyurethane, etc. laminated on the surface of the leather-like sheet substrate is made into a film by embossing, although not particularly limited thereto.

The resin for the surface resin film is not particularly restricted, and is preferably of the same kind as the polymeric elastomer constituting the leather-like sheet substrate, for example, polyurethane resin if the polymeric elastomer is polyurethane resin. The thickness of the surface resin film is preferably about 10 to 300 μm in view of touch or feel and appearance.

The suede-finished leather-like sheet and the grained leather-like sheet thus produced are suitably used as the materials for clothing and create a good wearing comfort because of its good stretchability and a natural, graceful silhouette because of its good drapeability. The applications of the leather-like sheet substrate of the present invention are not limited only to those described above.

The present invention will be described in more detail with reference to the following examples. However, it should be noted that the following examples are only illustrative and not intended to limit the scope of the invention thereto. The "part" and "%" used below are based on the mass, unless otherwise specified. The properties were measured by the following methods.

Average Single Fiber Fineness (dtex)

For the composite spun fiber, calculated from the averaged value of the diameters of single fibers in the microfine fiber bundle measured on a cross-sectional electron microphotograph (2,000×) of the leather-like sheet substrate. For the mix spun fiber, calculated from the quotient resulting from the division of the total content of island component by the number of islands counted on a similar electron microphotograph.

Fiber Diameter Ratio (D1/D2)

Calculated from the maximum fiber diameter D1 and the minimum fiber diameter D2 observed in the cross-sectional image of the microfine fiber bundle (A) on the electron microphotograph for the measurement of average single fiber fineness.

Tensile Strength at Break, Elongation at Break and Tear Strength

Measured by the method according to JIS L-1079, 5.12.

Sticking of Elastic Microfine Fibers

The sticking of the elastic microfine fibers was evaluated on a cross-sectional electron microphotograph (2,000×) of the leather-like sheet substrate. In case of the suede-finished leather-like sheet, the sticking was evaluated on electron microphotographs of the surface and the cross section thereof taken in the same manner.

Appearance, Touch or Feel, Drapeability and Stretchability

Evaluated by 10 persons engaged in the production of artificial leathers according to the following ratings:

A: Good

B: Moderate

C: Poor

The results were

Each result was shown by the most frequent rating.

30% Extension Elastic Recovery

A test sheet was extended by 30% of its original length and allowed to stand for one minute. After 3 min of removing the stress, the recovery was measured. The average of the recoveries in the machine direction and the transverse direction was shown as the 30% extension elastic recovery.

SPINNING EXAMPLE 1

Polyurethane ("Kuramiron U-3195" available from Kuraray Co., Ltd.; JIS A hardness: 95) as the island component and polyethylene ("FL60" available from Mitsui Chemicals, Inc.) as the sea component were spun into a microfine fiber-forming fiber (sea component/island component=50/50 by mass; the number of islands=25) by a sea-island composite spinning method using a needle pipe-type nozzle.

The microfine fiber-forming fiber was drawn 2.5 times (0.8 time the maximum draw ratio) in a warm water at 70° C., oiled, mechanically crimped, dried and then cut into 51 mm-long staples of 4.0 dtex. The shrinkage in a hot water at 90° C. was 45%. Repeating the immersion in 90° C. toluene and subsequent squeeze by a hand roller several times, the sea component was removed by extraction to convert the staples to microfine fibers having an average single fiber fineness of 0.08 dtex and a fiber diameter ratio of 1.2.

SPINNING EXAMPLE 2

Polyurethane ("Kuramiron U-3193" available from Kuraray Co., Ltd.; JIS A hardness: 93) as the island component and a dry blend of silicone powder ("KMP-590" available from Shin-Etsu Chemical Co., Ltd.) having an average particle size of 2 μm and polyethylene ("FL60" available from Mitsui Chemicals, Inc.) as the sea component (silicone powder: polyethylene=1:100 by mass) were spun into a microfine fiber-forming fiber (sea component/island component=50/50 by mass; the number of islands=25) by a sea-island composite spinning method using a needle pipe-type nozzle.

The microfine fiber-forming fiber was drawn 2.5 times (0.8 time the maximum draw ratio) in a warm water at 70° C., oiled, mechanically crimped, dried and then cut into 51 mm-long staples of 4.0 dtex. The shrinkage in a hot water at 90° C. was 43%. In the same manner as in Spinning Example 1, the staples were converted into microfine fibers having an average single fiber fineness of 0.08 dtex and a fiber diameter ratio of 1.2.

SPINNING EXAMPLE 3

In the same manner as in Spinning Example 1 except for using polyurethane ("Kuramiron U-3185" available from Kuraray Co., Ltd.; JIS A hardness: 85) as the island component, staples of 4.0 dtex were produced. The shrinkage in a hot water at 90° C. was 42%. In the same manner as in Spinning Example 1, the staples were converted into microfine fibers having an average single fiber fineness of 0.08 dtex and a fiber diameter ratio of 1.1.

SPINNING EXAMPLE 4

A 50/50 (by mass) dry blend of polyurethane ("Kuramiron U-3197" available from Kuraray Co., Ltd.; JIS A hardness: 97) and polyethylene ("FL60") was mix spun into a microfine fiber-forming fiber having a polyethylene sea component. The number of islands was about 300. The microfine fiber-forming fiber was made into staples of 4.0 dtex in the same manner as in Spinning Example 1. The shrinkage in a hot water at 90° C. was 27%. In the same manner as in Spinning Example 1, the staples were converted into microfine fibers. The average single fiber fineness was 0.007 dtex and the fiber diameter ratio exceeded 10.

SPINNING EXAMPLE 5

A 50/50 (by mass) dry blend of nylon-6 and polyethylene was mix spun into a microfine fiber-forming fiber having a polyethylene sea component. The number of nylon islands was about 600. The microfine fiber-forming fiber was drawn 2.5 times (0.8 time the maximum draw ratio) in a warm water at 70° C., oiled, mechanically crimped, dried and then cut into 51 mm-long staples of 4.0 dtex. The shrinkage in a hot water at 90° C. was 3%. In the same manner as in Spinning Example 1, the staples were converted into microfine fibers. The average single fiber fineness was 0.004 dtex.

EXAMPLE 1

The staples prepared in Spinning Examples 1 and 5 were blended in a ratio of 50/50 by mass and made into a web of 260 g/m$^2$ by a cross-lap method. The web was needle-punched alternately from both surfaces in a total punching density of about 2,500 punches/cm$^2$. The needle-punched web was shrunk in a hot water at 90° C., heat-dried at 130° C., and immediately thereafter pressed by calender rolls to prepare a fiber-entangled nonwoven fabric having a smooth surface. The mass per unit area was 535 g/m$^2$ and the apparent specific gravity was 0.48 g/cm$^3$. After a polyurethane emulsion ("Vondic 1310NSA" available from Dainippon Ink & Chemicals, Inc.) was impregnated into the fiber-entangled nonwoven fabric and solidified by drying, the polyethylene component was removed by extraction in a hot toluene to obtain a leather-like sheet substrate having a polymeric elastomer/fiber ratio of 10/90 by mass, a mass per unit area of 498 g/m$^2$, an apparent specific gravity of 0.45 g/cm$^3$ and a thickness of 1.1 mm. In the microfine fiber bundle derived from the microfine fiber-forming fiber of Spinning Example 1, the polyurethane microfine fibers partially stuck together. With this sticking structure, the leather-like sheet substrate had a sufficient mechanical strength and good stretchability in both the machine and transverse directions.

EXAMPLE 2

A fiber-entangled nonwoven fabric was prepared in the same manner as in Example 1 except for using the staples obtained in Spinning Examples 2 and 5. The mass per unit area was 550 g/m$^2$ and the apparent specific gravity was 0.46 g/cm$^3$. By treating the fiber-entangled nonwoven fabric in the same manner as in Example 1, a leather-like sheet substrate having a polymeric elastomer/fiber ratio of 10/90 by mass, a mass per unit area of 504 g/m$^2$, an apparent specific gravity of 0.46 g/cm$^3$ and a thickness of 1.1 mm. In the microfine fiber bundle derived from the microfine fiber-forming fiber of Spinning Example 2, the powder was present scattered between the microfine fibers to prevent the sticking thereof, but the microfine fibers partially stuck together where the powder was not present. The resultant leather-like sheet substrate had a sufficient mechanical strength and good stretchability in both the machine and transverse directions.

COMPARATIVE EXAMPLE 1

A fiber-entangled nonwoven fabric having a smooth surface was prepared in the same manner as in Example 1 except for using the staples obtained in Spinning Examples 3 and 5. The mass per unit area was 510 g/m$^2$ and the apparent specific gravity was 0.46 g/cm$^3$. After a polyurethane emulsion ("Vondic 1310NSA" available from Dainippon Ink & Chemicals, Inc.) was impregnated into the fiber-entangled nonwoven fabric and solidified by drying, the polyethylene component was removed by extraction in a hot toluene to obtain a leather-like sheet substrate having a polymeric elastomer/fiber ratio of 10/90 by mass, a mass per unit area of 525 g/m$^2$, an apparent specific gravity of 0.48 g/cm$^3$ and a thickness of 1.1 mm. In the microfine fiber bundle derived from the microfine fiber-forming fiber of Spinning Example 3, the microfine fibers excessively stuck together to be integrated into just a single thick fiber. Some of such integrated fibers partially stuck to intersecting fiber bundles. The resultant leather-like sheet substrate was sufficient in the stretchability in both the machine and transverse directions, but poor in the tear strength.

COMPARATIVE EXAMPLE 2

A fiber-entangled nonwoven fabric having a smooth surface was prepared in the same manner as in Example 1 except for using the staples obtained in Spinning Examples 4 and 5. The mass per unit area was 440 g/m$^2$ and the apparent specific gravity was 0.39 g/cm$^3$. After a polyurethane emulsion ("Vondic 1310NSA" available from Dainippon Ink & Chemicals, Inc.) was impregnated into the fiber-entangled nonwoven fabric and solidified by drying, the polyethylene component was removed by extraction in a hot toluene to obtain a leather-like sheet substrate having a polymeric elastomer/fiber ratio of 20/80 by mass, a mass per unit area of 449 g/m$^2$, an apparent specific gravity of 0.41 g/cm$^3$ and a thickness of 1.1 mm. In the microfine fiber bundle derived from the microfine fiber-forming fiber of Spinning Example 4, the microfine fibers excessively stuck together to be integrated into just a single thick fiber, but no sticking between the integrated fiber and the intersecting fiber bundle was observed. The resultant leather-like sheet substrate was sufficient in the mechanical properties, but poor in the stretchability in both the machine and transverse directions.

COMPARATIVE EXAMPLE 3

A fiber-entangled nonwoven fabric having a smooth surface was prepared in the same manner as in Example 1 except for using only the staples obtained in Spinning Example 5. The mass per unit area was 384 g/m$^2$ and the apparent specific gravity was 0.32 g/cm$^3$. After a polyurethane emulsion ("Vondic 1310NSA" available from Dainippon Ink & Chemicals, Inc.) was impregnated into the fiber-entangled nonwoven fabric and solidified by drying, the polyethylene component was removed by extraction in a hot toluene to obtain a leather-like sheet substrate having a polymeric elastomer/fiber ratio of 30/70 by mass, a mass per unit area of 450 g/m$^2$, an apparent specific gravity of 0.41 g/cm$^3$ and a thickness of 1.1 mm. In the microfine fiber bundle, the sticking between the microfine fibers was little observed. The resultant leather-like sheet substrate was sufficient in the mechanical properties, but hardly stretchable in both the machine and transverse directions.

EXAMPLE 3

The leather-like sheet substrate obtained in Example 1 was sliced along its major surface to obtain a thin leather-like sheet of 0.5 mm thick. After raising the surface opposite to the sliced surface by buffing with a #400 paper, the raised surface was dyed under the following conditions to obtain a suede-finished leather-like sheet.

Dyeing Conditions:

Dyeing: at 90° C. for 40 min by Wince dyeing machine

Dye: Irgalan Brown 2 GL (available from Ciba-Geigy AG), 1% owf

The resultant suede-finished leather-like sheet had a high-grade dense appearance with no sticking between the polyurethane microfine fibers which constituted the raised surface. The stretchability in the machine and transverse directions and the drapeability were also excellent.

COMPARATIVE EXAMPLE 4

A suede-finished leather-like sheet was produced in the same manner as in Example 3 except for using the leather-like sheet substrate obtained in Comparative Example 1. The polyurethane microfine fibers which constituted the raised surface stuck together into thick fibers to make the touch rough and impart an appearance with color shading, thereby failing to achieve a high quality. Although stretchable in the machine and transverse directions, the suede-finished leather-like sheet showed a slight repulsion and a poor drape ability.

EXAMPLE 4

A grained leather-like sheet was produced by dry-laminating a grain layer of the following formulation on the leather-like sheet substrate obtained in Example 2. The resultant grained leather-like sheet was soft, sufficiently stretchable, and very expressive. Top Layer (part(s) by mass):

| | |
|---|---|
| HYDRAN WLS-210 | 100 |
| HYDRAN ASSISTOR-W1 | 0.2 |
| DILAC HS-9510 | 10 |
| HYDRAN ASSISTOR-T3 | 0.6 |
| HYDRAN ASSISTOR-C6 | 4 |

All available from Dainippon Ink & Chemicals, Inc. Adhesive Layer (part(s) by mass):

| | |
|---|---|
| HYDRAN WLA-311 | 100 |
| HYDRAN ASSISTOR-W1 | 0.2 |
| HYDRAN ASSISTOR-T3 | 1.3 |
| HYDRAN ASSISTOR-C5 | 10 |

All available from Dainippon Ink & Chemicals, Inc.

The top layer was prepared by applying a solution of the above formulation having a 6,000 mPa·s viscosity on a release paper at 80 g/m$^2$ by wet basis and drying it at 100° C. for 5 min. Then, the adhesive layer was formed by applying a solution of the above formulation having a viscosity of 4,000 mPa·s on the top layer at 150 g/m$^2$ by wet basis and hot-air drying at 70° C. for 4 min. The top layer was dry-laminated on the leather-like sheet substrate via the adhesive layer and then cured at 120° C. for 2 min to produce the grained leather-like sheet.

The results of examples and comparative examples are shown in Tables 1 and 2.

TABLE 1

| | Examples | | Comparative Examples | | |
|---|---|---|---|---|---|
| | 1 | 2 | 1 | 2 | 3 |
| Microfine Fiber Bundle | | | | | |
| kind (spinning example) | 1/5 | 2/5 | 3/5 | 4/5 | 5 |
| blending ratio (by mass) | 50/50 | 50/50 | 50/50 | 50/50 | — |
| Polymeric elastomer/fiber (by mass) | 10/90 | 10/90 | 10/90 | 20/80 | 30/70 |
| Mass per unit area (g/m$^2$) | 528 | 550 | 525 | 449 | 450 |
| Thickness (mm) | 1.1 | 1.1 | 1.1 | 1.1 | 1.1 |
| Apparent specific gravity (g/cm$^3$) | 0.45 | 0.46 | 0.48 | 0.41 | 0.41 |

TABLE 1-continued

| | Examples | | Comparative Examples | | |
|---|---|---|---|---|---|
| | 1 | 2 | 1 | 2 | 3 |
| Tensile strength at break (kg/25 mm) | | | | | |
| machine direction | 23 | 22 | 23 | 17 | 32 |
| transverse direction | 21 | 21 | 24 | 16 | 35 |
| Elongation at break (%) | | | | | |
| machine direction | 220 | 210 | 230 | 170 | 90 |
| transverse direction | 190 | 200 | 210 | 200 | 120 |
| Tear strength (kg) | | | | | |
| machine direction | 11 | 10 | 6 | 10 | 13 |
| transverse direction | 11 | 11 | 5 | 10 | 11 |
| Appearance | A | A | C | C | A |
| Touch or Feel | A | A | A | B | B |
| Stretchability | A | A | A | B | C |
| Extension elastic recovery (%) | 92 | 92 | 88 | 86 | 76 |

TABLE 2

| | Examples | | Comparative |
|---|---|---|---|
| | 3 | 4 | Example 4 |
| Leather-like sheet substrate | Ex. 1 | Ex. 2 | Com. Ex. 1 |
| Mass per unit area (g/m$^2$) | 228 | 686 | 232 |
| Thickness (mm) | 0.5 | 1.2 | 0.5 |
| Apparent specific gravity (g/m$^3$) | 0.45 | 0.57 | 0.46 |
| Tensile strength at break (kg/25 mm) | | | |
| machine direction | 11 | 28 | 10 |
| transverse direction | 10 | 32 | 10 |
| Elongation at break (%) | | | |
| machine direction | 210 | 180 | 210 |
| transverse direction | 190 | 170 | 200 |
| Tear strength (kg) | | | |
| machine direction | 4 | 7 | 3 |
| transverse direction | 5 | 7 | 3 |
| Appearance | A | A | C |
| Touch or Feel | A | A | B |
| Drapeability | A | A | B |
| Stretchability | A | A | A |
| Extension elastic recovery (%) | 90 | 91 | 86 |

What is claimed is:

1. A leather-like sheet substrate comprising a fiber-entangled nonwoven fabric that comprises a microfine fiber bundle (A) and a microfine fiber bundle (B) in a blending ratio (A)/(B) of 30/70 to 70/30 by mass and a polymeric elastomer contained in the fiber-entangled nonwoven fabric, the microfine fiber bundle (A) comprising 10 to 100 microfine fibers each of which has a single fiber fineness of 0.5 dtex or less and which are made of an elastic polymer having a JIS A hardness of 90 to 97, and the microfine fiber bundle (B) comprising a microfine fiber which has a single fiber fineness of 0.5 dtex or less and which is made of a non-elastic polymer, wherein microfine fiber bundle (A) does not contain microfine fibers made of non-elastic polymers and that microfine fiber bundle (B) does not contain microfine fibers which have a single fiber fineness of 0.5 dtex or less and which are made of an elastic polymer having a JIS A hardness of 90 to 97, and wherein the microfine fibers in the microfine fiber bundle (A) inside the leather-like sheet substrate partially stick to each other, such that the elastic microfine fibers in the microfine fiber bundle (A) laterally stick together while keeping their original fibrous shape, and that the sticking length is ⅔ or less of the fiber diameter when measured on a cross section perpendicular to the lengthwise direction of fibers.

2. The leather-like sheet substrate according to claim 1, wherein a powder having an average particle size of 0.1 to 5 μm is present at least between the microfine fibers in the microfine fiber bundle (A).

3. The leather-like sheet substrate according to claim 1, which is made into a suede-finished leather-like sheet by raising the microfine fibers on a surface of the leather-like sheet substrate.

4. The leather-like sheet substrate according to claim 3, wherein raised single fibers each made of the microfine fiber in the microfine fiber bundle (A) do not stick to each other.

5. The leather-like sheet substrate according to claim 1, which is made into a grained leather-like sheet by forming a resin film on a surface of the leather-like sheet substrate.

6. A process for producing a leather-like sheet substrate according to claim 1, comprising at least the following (1) to (6):

(1) producing a microfine fiber-forming fiber (A') capable of forming a microfine fiber bundle (A) comprising 10 to 100 microfine fibers each of which has a single fiber fineness of 0.5 dtex or less and which are made of an elastic polymer having a JIS A hardness of 90 to 97;

(2) producing a microfine fiber-forming fiber (B') capable of forming a microfine fiber bundle (B) comprising microfine fibers each of which has a single fiber fineness of 0.5 dtex or less and which are made of a non-elastic polymer;

(3) producing a fiber-entangled nonwoven fabric (A) by blending the microfine fiber-forming fiber (A') and the microfine fiber-forming fiber (B') so that a blending ratio of the microfine fiber bundle (A) to the microfine fiber bundle (B) is 30/70 to 70/30 by mass when the microfine fiber-forming fibers (A') and (B') are made into the microfine bundles in (6), thereby producing a web, and by three-dimensionally entangling the web;

(4) producing a fiber-entangled nonwoven fabric (B) by heat-shrinking the fiber-entangled nonwoven fabric (A) at 85° C. or higher;

(5) impregnating a polymeric elastomer into the fiber-entangled nonwoven fabric (B); and (6) making the microfine fiber-forming fiber (A') and the microfine fiber-forming fiber (B') into the microfine fibers to form the microfine fiber bundle (A) and the microfine fiber bundle (B).

* * * * *